US007271816B2

(12) United States Patent
Tezuka et al.

(10) Patent No.: US 7,271,816 B2
(45) Date of Patent: Sep. 18, 2007

(54) DISPLAY APPARATUS, DISPLAY METHOD, AND DISPLAY APPARATUS CONTROLLER

(75) Inventors: Tadanori Tezuka, Fukuoka-Ken (JP); Hiroyuki Yoshida, Fukuoka-Ken (JP); Bunpei Toji, Iizuka (JP)

(73) Assignee: Matsushita Electric Industrial Co. Ltd., Osaka (JP)

( * ) Notice: Subject to any disclaimer, the term of this patent is extended or adjusted under 35 U.S.C. 154(b) by 247 days.

(21) Appl. No.: 10/125,213

(22) Filed: Apr. 18, 2002

(65) Prior Publication Data

US 2002/0154152 A1 Oct. 24, 2002

(30) Foreign Application Priority Data

Apr. 20, 2001 (JP) ..... 2001-122273

(51) Int. Cl.
*G06G 5/10* (2006.01)
*G06G 5/02* (2006.01)

(52) U.S. Cl. ..... 345/690; 345/600

(58) Field of Classification Search ..... 345/613, 345/690–696, 600–605; 348/661, 671, 712, 348/713

See application file for complete search history.

(56) References Cited

U.S. PATENT DOCUMENTS

| | | | | |
|---|---|---|---|---|
| 4,720,745 | A | | 1/1988 | DeForest et al. |
| 4,725,828 | A | | 2/1988 | Cowlishaw |
| 5,164,825 | A | | 11/1992 | Kobayashi et al. |
| 5,334,996 | A | | 8/1994 | Tanigaki et al. |
| 5,404,447 | A | | 4/1995 | Drako et al. |
| 5,432,890 | A | | 7/1995 | Watanabe |
| 5,450,208 | A | | 9/1995 | Murata |
| 5,543,819 | A | | 8/1996 | Farwell et al. |
| 5,623,593 | A | | 4/1997 | Spells, III |
| 5,633,654 | A | | 5/1997 | Kennedy et al. |
| 5,748,178 | A | | 5/1998 | Drewry |
| 5,768,490 | A | | 6/1998 | Hersch et al. |
| 5,796,445 | A | * | 8/1998 | Nomura et al. ..... 348/607 |
| 5,821,913 | A | | 10/1998 | Mamiya |
| 5,838,385 | A | | 11/1998 | Reder et al. |
| 5,852,443 | A | | 12/1998 | Kenworthy |

(Continued)

FOREIGN PATENT DOCUMENTS

EP 0 710 925 A2 5/1996

(Continued)

OTHER PUBLICATIONS

Jack, Keith, "Consumer Analog RGB and YUV Video Formats," Feb. 1998, Intersil Corp., AN9727.1.*

(Continued)

*Primary Examiner*—Alexnader Eisen
(74) *Attorney, Agent, or Firm*—Darby & Darby

(57) ABSTRACT

Color sub-pixel display is performed with a display device that has three light emitting elements for emitting three primary colors R, G, and B, respectively, aligned in an x-y matrix. Color information at pixel accuracy is separated into luminance data at pixel accuracy and chroma data at pixel accuracy. From the luminance data at pixel accuracy, luminance data at sub-pixel accuracy is generated. The luminance data at sub-pixel accuracy and chroma data at pixel accuracy are synthesized, whereby color information at sub-pixel accuracy is obtained.

11 Claims, 7 Drawing Sheets

U.S. PATENT DOCUMENTS

| | | | | |
|---|---|---|---|---|
| 5,852,673 | A | 12/1998 | Young | |
| 5,910,805 | A | 6/1999 | Hickey et al. | |
| 5,923,316 | A | 7/1999 | Kitamura et al. | |
| 6,008,820 | A | 12/1999 | Chauvin et al. | |
| 6,163,308 | A * | 12/2000 | Cavallerano et al. | 345/4 |
| 6,181,353 | B1 | 1/2001 | Kurisu | |
| 6,188,385 | B1 | 2/2001 | Hill et al. | |
| 6,219,011 | B1 | 4/2001 | Aloni et al. | |
| 6,219,025 | B1 | 4/2001 | Hill et al. | |
| 6,225,973 | B1 | 5/2001 | Hill et al. | |
| 6,236,390 | B1 | 5/2001 | Hitchcock | |
| 6,239,783 | B1 | 5/2001 | Hill et al. | |
| 6,239,789 | B1 | 5/2001 | Sekizawa et al. | |
| 6,243,055 | B1 | 6/2001 | Fergason | |
| 6,243,070 | B1 | 6/2001 | Hill et al. | |
| 6,278,434 | B1 | 8/2001 | Hill et al. | |
| 6,288,703 | B1 | 9/2001 | Berman et al. | |
| 6,299,930 | B1 | 10/2001 | Marotta et al. | |
| 6,342,896 | B1 | 1/2002 | Shetter et al. | |
| 6,356,278 | B1 * | 3/2002 | Stamm et al. | 345/611 |
| 6,360,023 | B1 | 3/2002 | Betrisey et al. | |
| 6,377,273 | B1 | 4/2002 | Lee et al. | |
| 6,384,839 | B1 | 5/2002 | Paul | |
| 6,396,505 | B1 | 5/2002 | Lui et al. | |
| 6,509,904 | B1 | 1/2003 | Lam | |
| 6,532,041 | B1 | 3/2003 | Monta et al. | |
| 6,542,161 | B1 | 4/2003 | Koyama et al. | |
| 6,563,502 | B1 | 5/2003 | Dowling et al. | |
| 6,608,632 | B2 | 8/2003 | Daly et al. | |
| 6,681,053 | B1 | 1/2004 | Zhu et al. | |
| 6,750,875 | B1 | 6/2004 | Keely | |
| 6,756,992 | B2 | 6/2004 | Toji et al. | |
| 6,775,420 | B2 | 8/2004 | Daly | |

FOREIGN PATENT DOCUMENTS

| | | | |
|---|---|---|---|
| EP | 1087341 | | 3/2001 |
| EP | 1 158 485 | A2 | 12/2001 |
| JP | 08-66778 | A1 | 6/1996 |
| JP | 2002-099239 | A1 | 4/2002 |
| WO | WO-00/21066 | A1 | 4/2000 |
| WO | WO-00/21067 | A1 | 4/2000 |
| WO | WO-00/21068 | A1 | 4/2000 |
| WO | WO-00/21070 | A1 | 4/2000 |
| WO | WO-00/42564 | A1 | 7/2000 |
| WO | WO-00/57305 | A1 | 9/2000 |
| WO | WO-01/09824 | | 2/2001 |
| WO | WO-01/09873 | | 2/2001 |

OTHER PUBLICATIONS

Printed version of http://grc.com/cleartype.htm, Sub-Pixel Font Rendering Technology, printed Mar. 22, 2002, last edit Feb. 20, 2000, pp. 1-2.

Printed version of http://grc.com/ctwhat.htm, Sub-Pixel Font Rendering Technology How it works, printed Mar. 22, 2002, last edit Feb. 11, 2002, pp. 1-9.

Markoff, John, "Microsoft's Cleartype Sets Off Debate on Originality", New York Times Online, Dec. 7, 1998, pp. 1-4.

S. Dibson "Sub-Pixel Font Rendering Technology: Implemantation Details" Internet 8 Dec. 1999 XP002239840.

European Search Report Allpication No. EP 02 007348 dated Aug. 29, 2006.

* cited by examiner

| | | | | |
|---|---|---|---|---|
| 1/9 | 2/9 | 3/9 | 2/9 | 1/9 |

target sub-pixel

DISPLAY APPARATUS, DISPLAY METHOD, AND DISPLAY APPARATUS CONTROLLER

BACKGROUND OF THE INVENTION

1. Field of the Invention

The present invention relates to display art for a display device with three primary color R, G, and B light emitting elements aligned, more specifically, the present invention relates to a color display at sub-pixel accuracy (the term color display in the present specification includes grayscale display and general color display).

2. Description of the Related Art

Conventionally, display apparatuses using various display devices have been used. Among such displays, for example, color LCDs, color plasma displays, and organic EL (electroluminescent) display apparatuses have a display screen in which three light emitting elements for emitting three primary colors R, G, and B are aligned in a fixed order to form one pixel. A plurality of pixels are aligned in a first direction to form one line. A plurality of thus formed lines are aligned in a second direction orthogonal to the first direction to form a display screen.

For example, display devices in cellular telephones and mobile computers, include many display devices which have a relatively narrow display screen and in which it is difficult to see detailed expressions. If an attempt is made to display small characters, photographs, and complicated figures with such a display device, part of the image easily loses its details and becomes unclear.

In order to improve display clarity on a narrow screen, on the Internet, literature (titled "Sub Pixel Font Rendering Technology") relating to sub-pixel display using a construction in which one pixel is formed of three R, G, and B light emitting elements is disclosed. The present inventors checked this literature upon downloading from a website provided by the Gibson Research Corporation (GRC) on Jun. 19, 2000. The principal disclosure from this web site is being filed with this application.

Referring now to FIG. 5 through FIGS. 9, the image of the alphabetic letter "A" is taken as an example of the image to be displayed.

FIG. 5 schematically shows one line where each pixel is formed of three light emitting elements. The horizontal direction in FIG. 5 (alignment direction of the three primary color R, G, and B light emitting elements) is referred to as a first direction. The vertical direction orthogonal to the first direction is referred to as a second direction.

Other alignment patterns can also be considered for the alignment of the light emitting elements in addition to the order of R, G, and B. Even when the alignment pattern is changed, this prior art and the present invention can be applied in the same manner.

The pixels thus formed of three light emitting elements are aligned in the first direction to form one line. The lines thus formed are aligned in the second direction to form a display screen.

Referring now to FIG. 6, original image data is acquired. Then, as shown in FIG. 7, three-time magnified image data is obtained by enlarging the original image data in the first direction (at a magnification equal to the number of R, G, and B light emitting elements).

Referring now to FIG. 8, colors are determined as shown for each pixel of FIG. 6. However, if display is made in this condition, color irregularities occur. Therefore, filtering is applied using luminance coefficients as shown in FIG. 9(*a*). A central target pixel is multiplied by a coefficient of 3/9, the next pixel is multiplied by a coefficient of 2/9, and the pixel after the next is multiplied by a coefficient of 1/9. whereby the luminance of each pixel is adjusted.

When filtering is applied to color pixels shown in FIG. 8, the pixels are adjusted as shown in FIG. 9(*b*). In the adjustment, blue is adjusted to light blue, yellow is adjusted to light yellow, reddish-brown is adjusted to light brown, and navy blue is adjusted to light navy blue.

An image that has been thus subjected to filtering is displayed by means of sub-pixel display by allocating the image to each light emitting element of FIG. 7.

However, in this display method, basically, only monochrome binary sub-pixel display is possible, and color image sub-pixel display is not possible.

OBJECTS AND SUMMARY OF THE INVENTION

Therefore, an object of the invention is to provide display art at sub-pixel accuracy compatible with the display of a color image.

A display apparatus according to a first aspect of the invention comprises a display device with a display screen in which one pixel is formed of three light emitting elements for emitting three primary colors R, G, and B aligned in a fixed order. The pixels are aligned in the first direction to form one line. A plurality of lines thus formed are aligned in the second direction, orthogonal to the first direction, to form the display screen. A luminance and chroma separating unit for inputting color information at pixel accuracy separate the inputted color information at pixel accuracy into luminance data at pixel accuracy and chroma data at pixel accuracy. A sub-pixel luminance data generating unit receives luminance data at pixel accuracy and generates luminance data at sub-pixel accuracy in one to one correspondence with three light emitting elements composing one pixel. A luminance and chroma synthesizing unit for outputting color information at sub-pixel accuracy synthesizes the generated luminance data at sub-pixel accuracy and chroma data at pixel accuracy. A display control unit controls each light emitting element of the display device using color information outputted from the luminance and chroma synthesizing unit to perform display with the display device.

In this construction, color information at pixel accuracy is temporarily separated into luminance data at pixel accuracy and chroma data at pixel accuracy. Then, luminance data at sub-pixel accuracy is generated from the luminance data at pixel accuracy. The luminance data at sub-pixel accuracy and chroma data at pixel accuracy are synthesized. As a result, luminance data at sub-pixel accuracy is reflected in the contents to be displayed, whereby sub-pixel display of a color image can be performed.

In a display apparatus according to a second aspect of the invention, chroma data at pixel accuracy is R, G, and B values in one to one correspondence with the three light emitting elements composing one pixel.

By this construction, components of chroma data correspond to the three light emitting elements composing one pixel of the display device, respectively. The data is chroma data at pixel accuracy, but can be substantially regarded as chroma data at sub-pixel accuracy corresponding to each light emitting element.

In a display apparatus according to a third aspect of the invention, chroma data at pixel accuracy is color differences Cb and Cr values that are equivalent to the R, G, and B values one to one correspondence with the three light emitting elements composing one pixel.

By this construction, chroma data at sub-pixel accuracy that is equivalent to the R, G, and B values and correspond to each light emitting element requires a smaller amount of data storage than the R, G, and B values.

A display apparatus according to a fourth aspect of the invention comprises a chroma distributing unit for inputting chroma data at pixel accuracy separated by the luminance and chroma separating unit. Processing is applied to prevent color irregularities. Chroma data is output after processing to the luminance and chroma synthesizing unit.

By this construction, color irregularities are prevented from being conspicuous by the chroma distributing unit, and display quality can be improved.

A display apparatus according to a fifth aspect of the invention comprises a blurring unit for applying blurring to eliminate color irregularities in color information at sub-pixel accuracy for outputting from the luminance and chroma separating unit. The display control unit uses the color information at sub-pixel accuracy that has been subjected to blurring.

By this construction, due to blurring, color irregularities are further securely prevented from being conspicuous, and display quality is improved.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Embodiment 1

<First Example>

Figure 1:
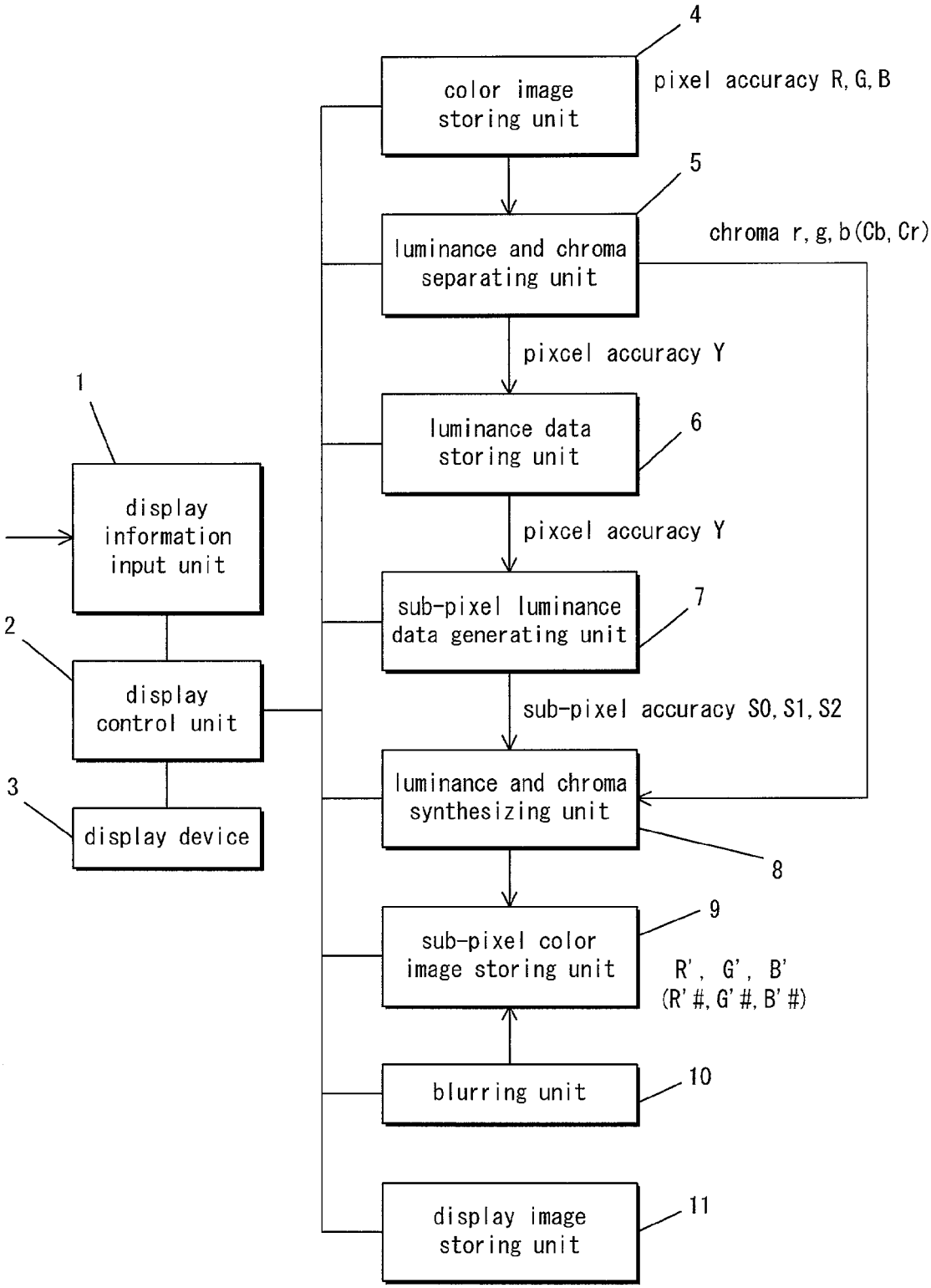
FIG. 1 is a block diagram of a display apparatus according to Embodiment 1 of the invention.

Referring to FIG. 1, a display information input unit 1 inputs color display information. A display control unit 2 controls each component of FIG. 1 and performs display with the display device based on a display image stored in a display image storing unit 11 (VRAM or the like) for sub-pixel display.

A display device 3 includes a display screen that is constructed so that three light emitting elements for emitting three primary colors R, G, and B are aligned in a fixed order to form one pixel. A plurality of the pixels thus formed are aligned in the first direction to form one line. A plurality of lines thus formed are aligned in the second direction orthogonal to the first direction to form a display screen. Concretely, the display device comprises a color LCD, color plasma display, or organic EL display. A conventional driver for driving each light emitting element is included in the display device.

The display control unit 2 stores color display information inputted from the display information input unit 1 in a color image storing unit 4. The color display information stored in the color image storing unit 4 is color information at pixel accuracy for each pixel of the display device 3. In this example, the color display information includes the R, G, and B values of each pixel P (x,y) which are R(x,y), G(x,y), and B(x,y), respectively.

For explanation convenience, hereinafter, the first direction is referred to as an x direction and the second direction is referred to as a y direction, however, the invention can be applied in the same manner with x and y exchanged.

A luminance and chroma separating unit 5 reads out R, G, and B values R(x,y), G(x,y), and B(x,y)) of each pixel from the color image storing unit 4, and separates them into luminance data Y(x,y) at pixel accuracy and chroma data r(x,y), g(x,y), and b(x,y) at pixel accuracy.

Concretely, the luminance and chroma separating unit 5 obtains luminance data Y(x,y) based on the following formula (1), and outputs the data to a sub-pixel luminance data generating unit 7.

$$Y(x,y)=\{R(x,y)+G(x,y)+B(x,y)\}/3 \quad (1)$$

The luminance data Y(x,y) in this example is different from that of general Y-C separation.

The luminance and chroma separating unit 5 obtains chroma data r(x,y), g(x,y), and b(x,y) based on the following formulas (2) through (4) and outputs the data to the luminance and chroma synthesizing unit 8.

$$r(x,y)=R(x,y)/Y \quad (2)$$

$$g(x,y)=G(x,y)/Y \quad (3)$$

$$b(x,y)=B(x,y)/Y \quad (4)$$

The chroma data r(x,y), g(x,y), and b(x,y) is at pixel accuracy. However, this data can be substantially regarded as being at sub-pixel accuracy since one pixel has three components that can be allocated, respectively, to three light emitting elements composing one pixel.

The sub-pixel luminance data generating unit 7 inputs luminance data Y(x,y) at pixel accuracy from the luminance data storing unit 6, and generates luminance data S0(x,y), S1(x,y), and S2(x,y) at sub-pixel accuracy at one to one correspondence with the three light emitting elements composing one pixel of the display device 3.

Herein, the method for the sub-pixel luminance data generating unit 7 to generate the luminance data S0(x,y), S1(x,y), and S2(x,y) can be freely selected. For example, the calculation described in the section of description of the Related Art can be applied.

A luminance and chroma synthesizing unit 8 inputs luminance data S0(x,y), S1(x,y), and S2(x,y) at sub-pixel accuracy from the sub-pixel luminance data generating unit 7 and inputs chroma data r(x,y), g(x,y), and b(x,y) at pixel accuracy (however, as mentioned above, substantially equivalent to sub-pixel accuracy) from the luminance and chroma separating unit 5.

The luminance and chroma synthesizing unit 8 synthesizes this luminance data and chroma data based on the following formulas (5) through (7) to obtain display data R'(x,y), G'(x,y), and B'(x,y) at sub-pixel accuracy compatible with color display, and stores the data in a sub-pixel color image storing unit 9.

$$R'(x,y)=r(x,y)\times \mathbf{S0}(x,y) \tag{5}$$

$$G'(x,y)=g(x,y)\times \mathbf{S1}(x,y) \tag{6}$$

$$B'(x,y)=b(x,y)\times \mathbf{S2}(x,y) \tag{7}$$

It is desirable that a blurring unit 10 be provided in order to improve display quality although it is possible to omit the unit. In this example, the blurring unit 10 inputs color information R'(x,y), G'(x,y), and'(Bx,y) that has been synthesized and stored in the sub-pixel color image storing unit 9, applies blurring based on the following formulas (8) through (10), and overwrites color information R#(x,y), G#(x,y), and B#(x,y) that have been subjected to blurring into the sub-pixel color image storing unit 9.

$$R\#(x,y)=\alpha\times R'(x-1,y)+\beta\times R'(x,y)+\gamma\times R'(x+1,y) \tag{8}$$

$$G\#(x,y)=\alpha\times G'(x-1,y)+\beta\times G'(x,y)+\gamma\times G'(x+1,y) \tag{9}$$

$$B\#(x,y)=\alpha\times B'(x-1,y)+\beta\times B'(x,y)+\gamma\times B'(x+1,y) \tag{10}$$

Where: α, β, and γ in formulas (8) through (10) are coefficients for preventing color irregularities. In this example, α=0.2, β=0.6, and γ=0.2. Of course, the values of formulas (8) through (10) and coefficients α, β, and γ are just examples, and may be variously changed.

When blurring is applied by the blurring unit 10, the display control unit 2 transfers the color information R#(x,y), G#(x,y), and B#(x,y) after it is subjected to blurring by the blurring unit 10 to a display image storing unit 11. When blurring is not applied, the display control unit 2 transfers the blurred color information R'(x,y), G'(x,y), and B'(x,y) to the display image storing unit 11.

In both cases, after completing transfer, the display control unit 2 performs display with the display device 3 based on the data of the display image storing unit 11.

The abovementioned storing units 4, 6, and 9 are normally defined as a fixed region of a memory except for a VRAM. However, the unit may be omitted unless the omission poses a problem in processing.

The display control unit 2, luminance and chroma separating unit 5, sub-pixel luminance data generating unit 7, and luminance and chroma synthesizing unit 8 may be mounted in one chip and constructed as a display apparatus controller.

Figure 2:
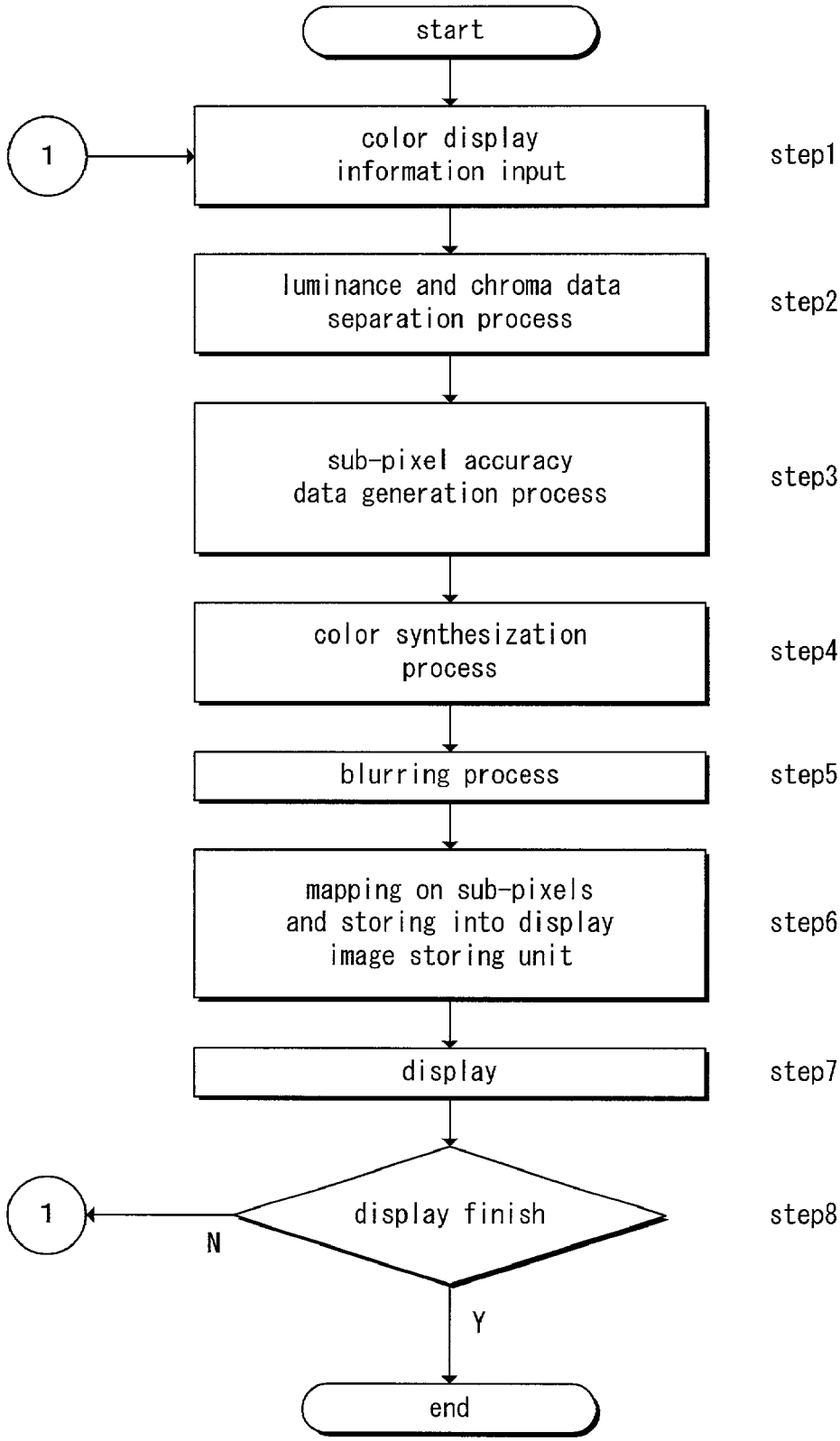
FIG. 2 is a flowchart of a display according to Embodiment 1 of the invention.

Referring now to FIG. 2, the flow of the display method in this embodiment is explained. First, in step 1, color display information is inputted into the display information input unit 1.

Then, the display control unit 2 stores the inputted color display information in the color image storing unit 4, and the luminance and chroma separating unit 5 separates the color information in the color image storing unit 4 into luminance data and chroma data (step 2).

After the separation processing, the luminance data is stored in the luminance data storing unit 6, and the chroma data is transmitted to the luminance and chroma synthesizing unit 8. Then, in step 3, the sub-pixel luminance data generating unit 7 converts the luminance data in the luminance data storing unit 6 into data at sub-pixel accuracy, and transmits the results of conversion to the luminance and chroma synthesizing unit 8.

Next, in step 4, the display control unit 2 transmits the luminance data and chroma data at sub-pixel accuracy to the luminance and chroma synthesizing unit 8. The luminance and chroma synthesizing unit 8 executes color synthesization processing as mentioned above.

After the color synthesization processing, synthesized color information is stored in the sub-pixel color image storing unit 9. Then, in step 5, the blurring unit 10 executes blurring. The results of blurring are stored in the sub-pixel color image storing unit 9. Step 5 may be omitted.

Then, the color information in the sub-pixel color image storing unit 9 is transferred to the display image storing unit 11 (step 6).

Then, in step 7, the display control unit 2 performs display with the display device 3 based on the information of the display image storing unit 11. Unless the display is finished (end), the display control unit 2 returns the process to step 1.

By the abovementioned construction, in addition to monochrome binary display, even with a color display (including grayscale display as mentioned above), clear display which is easy for users to look at is realized by preventing characters from being unclear by means of sub-pixel display.

<Second Example>

In this example, the following points are different from the first example.

The luminance and chroma separating unit 5 shown in FIG. 1 obtains luminance value Y(x,y) of a pixel P(x,y) based on the formula shown below. This luminance value is the same as that of general Y-C separation.

$$Y(x,y)=0.299\times R(x,y)+0.587\times G(x,y)+0.114\times B(x,y) \tag{11}$$

The luminance and chroma separating unit 5 obtains Cb(x,y) and Cr(x,y) as chroma values of the pixel P(x,y) based on the formulas shown below, and outputs these values to the luminance and chroma synthesizing unit 8.

$$Cb-(x,y)=-0.172\times R(x,y)-0.339\times G(x,y)+0.511\times B(x,y) \tag{12}$$

$$Cr(x,y)=0.511\times R(x,y)-0.428\times G(x,y)+0.083\times B(x,y) \tag{13}$$

Thereby, the chroma data at sub-pixel accuracy can be substantially handled but using an amount of data that is ⅔ that of the first example.

Furthermore, the luminance and chroma synthesizing unit 8 obtains display data R'(x,y), G'(x,y) and B'(x,y) at sub-pixel accuracy compatible with color display from the luminance data S0(x,y), S1(x,y), and S2(x,y) at sub-pixel accuracy stored in the sub-pixel luminance data generating unit 7 and chroma data Cr(x,y) and Cb(x,y) transmitted from the luminance and chroma separating unit 5 based on the formulas shown below, and stores the obtained data in the sub-pixel color image storing unit 9.

$$R'(x,y)=\mathbf{S0}(x,y)+1.371\times Cr(x,y) \tag{14}$$

$$G'(x,y)=\mathbf{S1}(x,y)0.698\times Cr(x,y)0.336\times Cb(x,y) \tag{15}$$

$$B'(x,y)=\mathbf{S2}(x,y)+1.732\times Cb(x,y) \tag{16}$$

Of course, formulas (11) through (16) and values thereof are just examples, and may be variously changed. It is also desirable in the second example that the blurring be applied by the blurring unit 10, however, this may be omitted.

Embodiment 2

Figure 3:
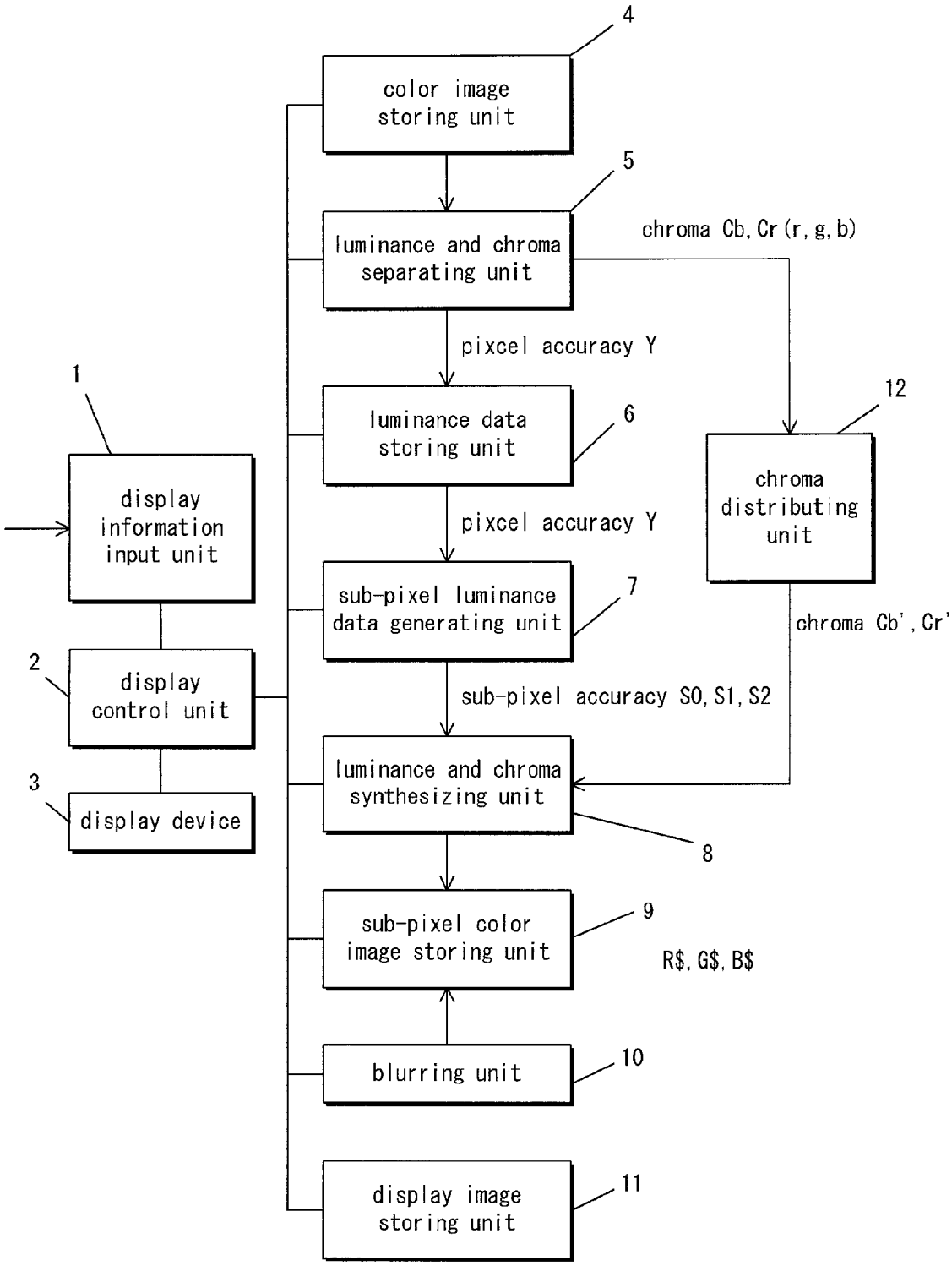
FIG. 3 is a block diagram of a display according to Embodiment 2 of the invention.
Figure 4:
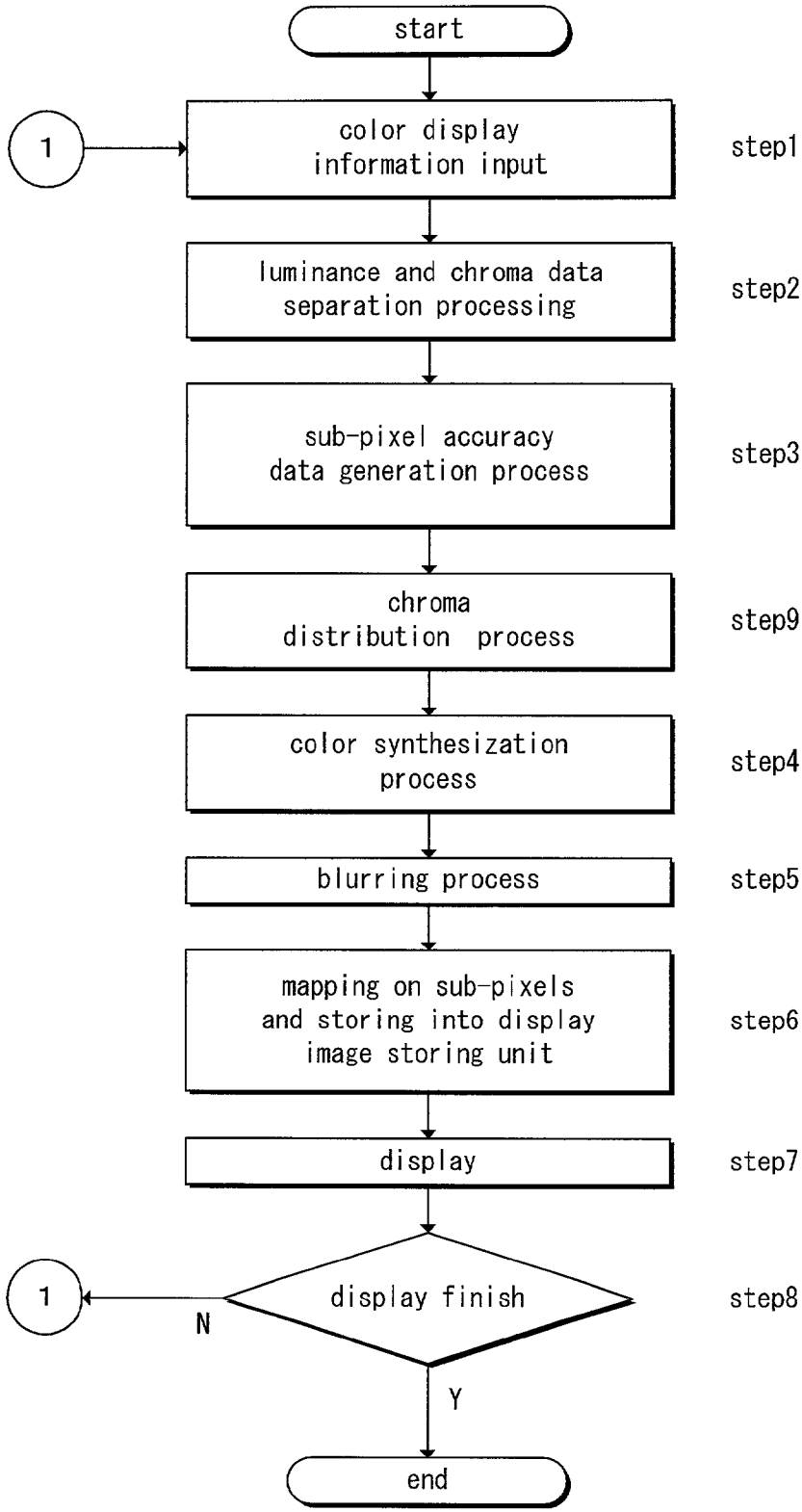
FIG. 4 is a flowchart of a display according to Embodiment 2 of the invention.
Figure 5:
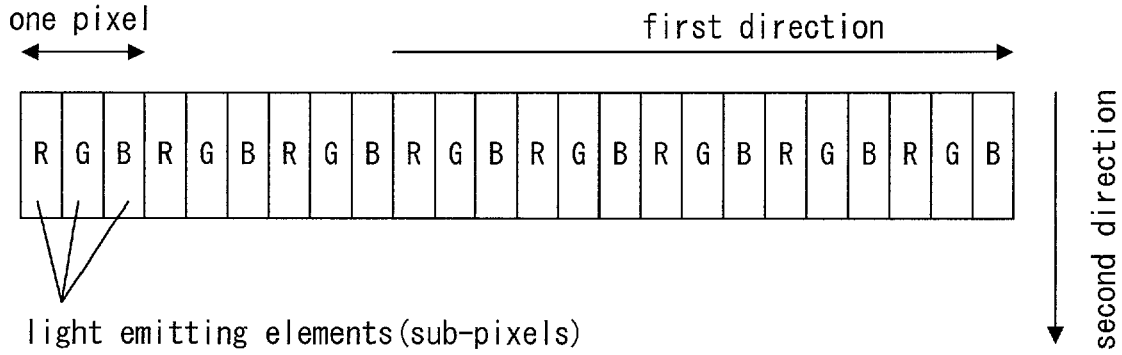
FIG. 5 is a construction drawing of one line on a display device.
Figure 6:
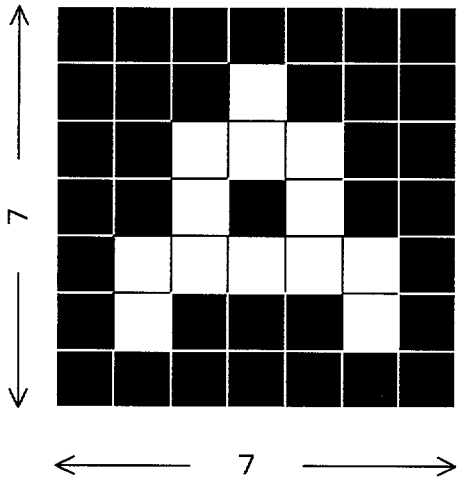
FIG. 6 is an illustration of an original image of a conventional example.
Figure 7:
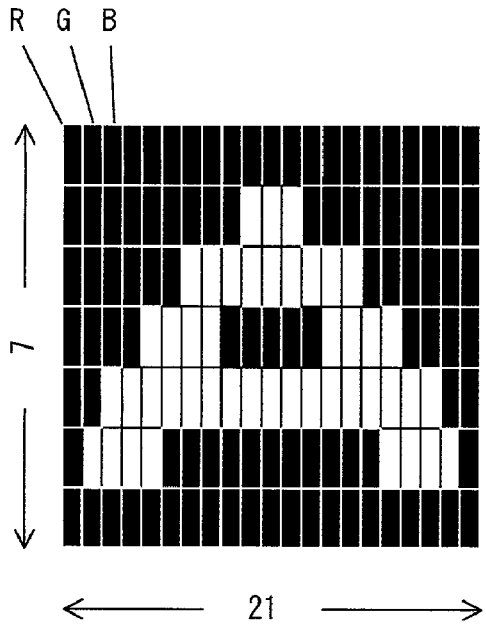
FIG. 7 is an illustration of a three-time magnified image of the conventional example.
Figure 8:
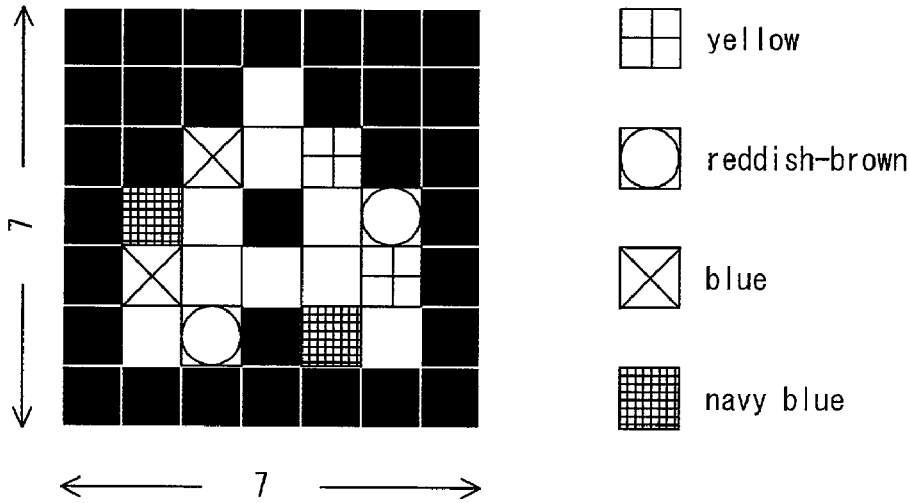
FIG. 8 is an illustration of determined colors of the conventional example.
Figures 9A, 9B:
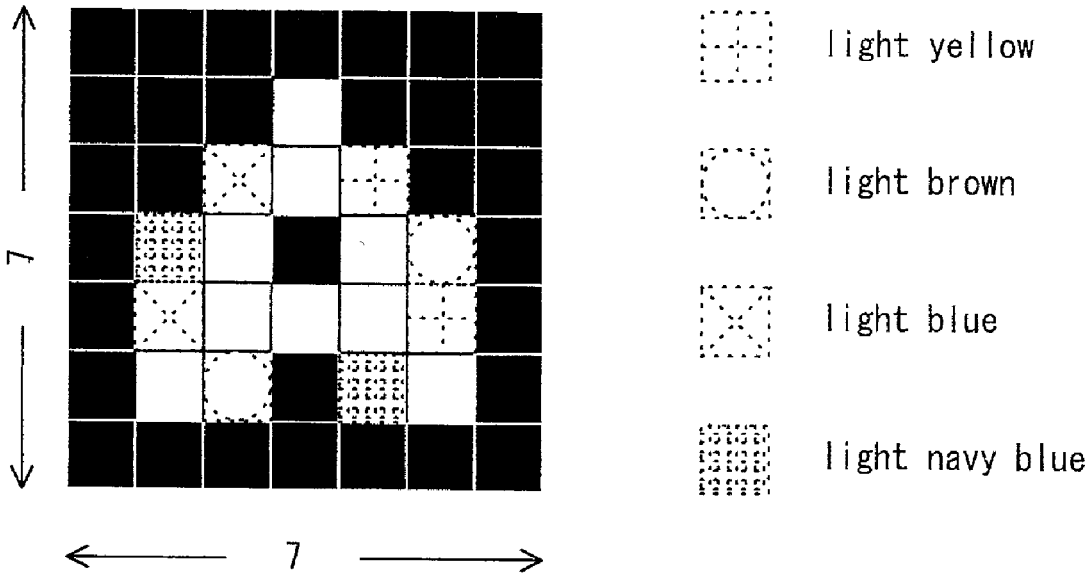
Prior Art Fig. 9(a)
Prior Art Fig. 9(b)
FIG. 9(A) is an illustration of determined colors (after filtering) of the conventional example.
FIG. 9(B) is an illustration of adjusting pixels of the conventional example.

In this embodiment, as shown in FIG. 3, a chroma distributing unit 12 is additionally provided between the luminance and chroma separating unit 5 and luminance and chroma synthesizing unit 8 of Embodiment 1. In the flow of processing, as shown in FIG. 4, chroma distribution processing (step 9) is added between step 3 and step 4. The order of step 3 and step 9 may be as shown in the figure, or may be changed to perform step 9 prior to step 3.

The chroma distributing unit 12 of FIG. 3 inputs chroma data Cb(x,y) and Cr(x,y) that has been separated by the luminance and chroma separating unit 5, executes processing for preventing color irregularities by means of the following formulas, obtains chroma values Cb'(x,y) and Cr'(x,y) after distribution, and transmits the results to the luminance and chroma synthesizing unit 8.

$$Cb'(x,y)=\alpha 1\times Cb(x-1,y)+\beta 1\times Cb(x,y)+\gamma 1\times Cb(x+1,y) \quad (17)$$

$$Cr'(x,y)=\alpha 2\times Cr(x-1,y)+\beta 2\times Cr(x,y)+\gamma 2\times Cr(x+1,y) \quad (18)$$

Herein: $\alpha 1$, $\beta 1$, $\gamma 1$, $\alpha 2$, $\beta 2$, and $\gamma 2$ in formulas (17) and (18) are coefficients for preventing color irregularities. If the coefficients for filtering to be used by the sub-pixel accuracy data generating unit 5 are 1/9, 2/9, 3/9, 2/9, and 1/9, in this example, $\alpha 1=4/18$, $\beta 1=13/18$, $\gamma 1=1/18$, $\alpha 2=1/18$, $\beta 2=13/18$, and $\gamma 2=4/18$. Of course, the values of these formulas and coefficients are just examples, and may be variously changed.

In the present embodiment, the luminance and chroma synthesizing unit 8 reads-out luminance data S0(x,y), S1(x,y), and S2(x,y) at sub-pixel accuracy from the sub-pixel luminance data generating unit 7, obtains chroma data Cr(x,y) and Cb(x,y) from the chroma distributing unit 12, determines display data R$(x,y), G$(x,y), and B$(x,y) at sub-pixel accuracy compatible with color display based on the following formulas, and stores the obtained data into the sub-pixel color image storing unit 9.

$$R\$(x,y)=S0(x,y)+1.37\times Cr'(x,y) \quad (19)$$

$$G\$(x,y)=S1(x,y)-0.698\times Cr'(x,y)0.336\times Cb(x,y) \quad (20)$$

$$B\$(x,y)=S2(x,y)+1.732\times Cb'(x,y) \quad (21)$$

Of course, the values of formulas (11) through (16) are only examples, and may be variously changed.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A display apparatus comprising:

a display device;

said display device being of a type in which three light emitting elements for emitting three primary colors R, G, and B are aligned in a fixed order to form one pixel;

a plurality of said pixels are aligned in a first direction to form one line;

a plurality of said lines are aligned in a second direction, orthogonal to said first direction, to form a display screen;

a luminance and chroma separating unit operable to input color information at pixel accuracy and to separate said color information into luminance data at pixel accuracy and chroma data at pixel accuracy;

a sub-pixel luminance data generating unit operable to receive said luminance data at pixel accuracy and to generate luminance data at sub-pixel accuracy at one to one correspondence with said three light emitting elements forming one pixel;

a luminance and chroma synthesizing unit operable to synthesize luminance data at sub-pixel accuracy and chroma data at pixel accuracy and to output color information at sub-pixel accuracy; and a display control unit operable to control each light emitting element of said display device by using color information from said luminance and chroma synthesizing unit and to perform display with said display device.

2. The display apparatus according to claim 1, wherein said chroma data at pixel accuracy is R, G, and B values at one to one correspondence with said three light emitting elements composing one pixel.

3. The display apparatus according to claim 1, wherein said chroma data at pixel accuracy is color difference Cb and Cr values equivalent to said R, G, and B values, wherein said R, G, and B values are at one to one correspondence with said three light emitting elements forming one pixel.

4. The display apparatus according to claim 1, further comprising:

a chroma distributing unit operable to input said chroma data at pixel accuracy that has been separated by said luminance and chroma separating unit;

the chroma distributing unit further operable to apply processing for preventing color irregularities to said data, and to output the processed chroma data to said luminance and chroma synthesizing unit.

5. The display apparatus according to claim 1, further comprising:

a blurring unit operable to blur said color information at sub-pixel accuracy outputted from said luminance and chroma separating unit to eliminate color irregularities; and said display control unit further operable to use color information at sub-pixel accuracy that has been subjected to blurring.

6. A display method for performing display with a display device, comprising:

aligning three light emitting elements for emitting three primary colors R, G, and B in a fixed order to form one pixel;

aligning a plurality of said pixels in a first direction to form one line;

aligning a plurality of said lines in a second direction, orthogonal to said first direction, to form a display screen;

inputting color information at pixel accuracy;

separating said inputted color information into luminance data at pixel accuracy and chroma data at pixel accuracy;

responsive to said luminance data at pixel accuracy, generating luminance data at sub-pixel accuracy in one to one correspondence with said three light emitting elements composing one pixel;

synthesizing said luminance data at sub-pixel accuracy and chroma data at pixel accuracy and outputting color information at sub-pixel accuracy; and controlling each light emitting element of said display device using said color information at sub-pixel accuracy to perform display with said display device.

7. The display method according to claim 6, wherein said chroma data at pixel accuracy is R, G, and B values in one to one correspondence with said three light emitting elements composing one pixel.

8. The display method according to claim 6, wherein said chroma data at pixel accuracy is color difference Cb and Cr values equivalent to said R, G, and B values, wherein said R, G, and B values are in one to one correspondence with said three light emitting elements composing one pixel.

9. The display method according to claim 6, wherein:

inputting said separated chroma data at pixel accuracy;

processing said chroma data for preventing color irregularities; and synthesizing processed chroma data and said generated luminance data at sub-pixel accuracy to output color information at sub-pixel accuracy.

10. The display method according to claim 6, further comprising:

blurring said color information at sub-pixel accuracy for eliminating color irregularities;

applying said color information at sub-pixel accuracy that has been subjected to blurring to control each light emitting element of said display device, whereby display is performed with said display device.

11. A display apparatus controller comprising:

a luminance and chroma separating unit operable to input color information at pixel accuracy and to separate said inputted color information into luminance data at pixel accuracy and chroma data at pixel accuracy;

a sub-pixel luminance data generating unit operable to receive said luminance data at pixel accuracy and to generate luminance data at sub-pixel accuracy in one to one correspondence with three light emitting elements composing one pixel;

a luminance and chroma synthesizing unit operable to synthesize said generated luminance data at sub-pixel accuracy and chroma data at pixel accuracy and to output color information at sub-pixel accuracy; and a display control unit operable to control each light emitting element of said display device by using said color information outputted by said luminance and chroma synthesizing unit and to perform display with said display device.

* * * * *